US007275580B2

(12) United States Patent
Yu et al.

(10) Patent No.: US 7,275,580 B2
(45) Date of Patent: Oct. 2, 2007

(54) ROMAN STYLE SHADE

(75) Inventors: Fu-Lai Yu, Taipei Hsieh (TW); Chin-Tien Huang, Taipei Hsieh (TW); Shun-Chi Yu, Taipei Hsieh (TW)

(73) Assignee: Teh Yor Co., Ltd., Taipei (TW)

( * ) Notice: Subject to any disclaimer, the term of this patent is extended or adjusted under 35 U.S.C. 154(b) by 182 days.

(21) Appl. No.: 10/914,579

(22) Filed: Aug. 9, 2004

(65) Prior Publication Data

US 2005/0006032 A1 Jan. 13, 2005

Related U.S. Application Data

(63) Continuation-in-part of application No. 10/427,829, filed on May 1, 2003, now Pat. No. 6,932,138.

(51) Int. Cl.
*A47H 5/00* (2006.01)

(52) U.S. Cl. ..... 160/84.01; 160/116; 160/180

(58) Field of Classification Search ..... 160/84.01, 160/84.03, 84.04, 84.05, 84.08, 116, 130, 160/180, 193, 121.1
See application file for complete search history.

(56) References Cited

U.S. PATENT DOCUMENTS

| | | | | |
|---|---|---|---|---|
| 2,267,869 | A | 12/1941 | Loehr | 160/89 |
| 4,951,729 | A | 8/1990 | Chi Yu | 160/178.3 |
| 5,165,459 | A | 11/1992 | Gaber et al. | 160/168.1 R |
| 5,375,642 | A | 12/1994 | Gaber et al. | 160/168.1 R |
| 5,409,050 | A | 4/1995 | Hong | 160/168.1 R |
| 5,582,226 | A | 12/1996 | Voss et al. | 160/168.1 R |
| 5,680,891 | A | 10/1997 | Prince | 160/84.05 |
| 5,733,632 | A | 3/1998 | Marusak | 428/181 |
| 5,787,951 | A | 8/1998 | Tonomura et al. | 160/84.01 |
| 5,845,690 | A | 12/1998 | Colson et al. | 160/84.01 |
| 5,918,655 | A | 7/1999 | Corey | 160/84.05 |
| 6,006,812 | A | 12/1999 | Corey | 160/84.05 |
| 6,029,734 | A | 2/2000 | Wang et al. | 160/170 |
| 6,354,353 | B1 | 3/2002 | Green et al. | 160/84.04 |
| 2003/0127196 | A1 | 7/2003 | Corey et al. | 160/84.05 |
| 2003/0188835 | A1 | 10/2003 | Corey et al. | 160/84.05 |

FOREIGN PATENT DOCUMENTS

| | | |
|---|---|---|
| DE | 28 44 891 A1 | 4/1980 |

*Primary Examiner*—Blair M. Johnson
(74) *Attorney, Agent, or Firm*—Olson & Hierl, Ltd.

(57) ABSTRACT

A window covering having a plurality of panels comprising a head rail and a plurality of panels suspended from the head rail by a securement member and at least one opening member is provided. Each of the plurality of panels is collapsible and includes a pair of opposed longitudinal regions. A bottom rail may also be provided and suspended from the head rail such that the plurality of panels are located between the head rail and the bottom rail.

25 Claims, 18 Drawing Sheets

ROMAN STYLE SHADE

RELATED APPLICATION

This application is a continuation in part of application Ser. No. 10/427,829, which was filed on May 1, 2003 now U.S. Pat. No. 6,932,138

TECHNICAL FIELD OF THE INVENTION

This invention relates to an improved window covering. More particularly, this invention relates to an improved window covering having the general appearance of a Roman shade but having the ability to provide openings at different intervals.

BACKGROUND OF THE INVENTION

One popular type of window covering is known as a Roman shade. This type of shade consists of a fabric material attached along its top edge to a head rail and gathered at spaced intervals to provide a series of soft folds across the face of the fabric. Consequently, the typical Roman shade has a cascaded or softly pleated appearance. Such Roman shades are constructed so that when they are raised, they gather from the bottom in generally horizontal folds or pleats until the entire shade resides near the top of the window covering. In some versions, the top of the window covering may also be lowered. The shades are operated by pulling on various lines which are used in conjunction with guides attached to the shade.

Most prior art Roman shades are formed either of a flexible material such as a fabric or of a plurality of panels, and are provided with a plurality of horizontal folds at points vertically spaced from one another to form the pleats when the shade is raised. A common method for making a Roman shade is to sew at least two sets of rings or connectors along vertical lines down the back of the fabric material such as is shown in U.S. Pat. No. 1,321,800. A lift cord passes from the head rail through each set of rings and may either be fastened to the bottom edge of the fabric or loop around the bottom edge of the fabric up the front face of the fabric and return to the head rail. Alternatively, each set of connectors is both sewn to the fabric and attached to a cord at spaced apart intervals along the cord. The interval between spacers on each cord may be equal to or less than the distance between the points at which the spacers are attached to the back of the fabric.

One drawback to the typical Roman shade, however, is that there is no way to create openings in the overall face of the window covering if one wishes to permit light into a room, such as found in Venetian blinds by tilting the blind slats, without having to raise the bottom, or lower the top of the entire window covering, which undesirably results in a substantial loss of privacy. Therefore, it is desired to provide the ability to, similar to a Venetian blind, open gaps in the shade to allow light to pass, yet maintain a relatively high degree of privacy by not requiring the shade to be raised or lowered. The present invention also overcomes the shortcoming of the prior art by keeping ladder or other raising and adjustment mechanisms from view when the shade is closed.

SUMMARY OF THE INVENTION

The present invention relates to a decorative covering suitable for use as a window shade. The decorative covering comprises a head rail with at least one securement member and at least a first opening member. The decorative covering also includes rows that are suspended from the head rail, and which are typically hung over a window as a shade.

The window covering preferably includes a plurality of securement members and a plurality of opening members suspended from the head rail. The securement members and opening members can take several forms, such as cords, narrow strips of material, a panel, or the like. Each of the plurality of securement members is restrainedly positioned with each of the plurality of rows at a first transverse margin or longitudinal region of the individual rows. Each of the rows also defines a plurality of row portions spaced in a transverse direction. Each of the rows is also connected to at least one opening member at a transverse margin or longitudinal region opposite that of the transverse margin or longitudinal region to which the securement members are restrainedly positioned, and to at least one of the row portions. A vertical adjustment mechanism is operatively connected to each of the opening members, which enables the opening member to be moved to open or close the spaced row portion of the rows restrainedly positioned therewith. A single adjustment mechanism can be operatively connected to all the opening members, or each of a plurality of opening members can be operatively connected only to certain opening members. In some embodiments, the securement members are also operatively connected with a vertical adjustment mechanism, and are movable to open or close the plurality of rows. The rows or row portions of the window covering can thereby be opened and closed through individual movement of the opening members or the securement member or a combination of both. In particular, the transverse margins or longitudinal portions of the rows are brought closer together to collapse the rows or are urged apart to extend the rows. For example, if the opening member is secured to the lower edge of the rows, when the opening member is retracted, the lower edge of each row is raised relative to the upper edge and drawn up behind the front of the row such that openings created in the face of the window covering permit light to pass. Extending the opening member through use of the vertical adjustment mechanism causes the lower edge of each row with which it is connected to lower relative to the upper edge and thereby close the gaps in the face of the window covering. In another embodiment, the securement member mechanism may also be extended or retracted through use of a vertical adjustment mechanism such as described above. With the adjustable securement member, openings in the decorative covering can be controlled by extending and retracting the securement member as well. In the above example, the securement member can lower the upper edge of the rows to create gaps in the face of the decorative covering. It should be understood that both the securement member and the opening member can be adjusted as desired. In other words, either the securement member can be adjusted, or the opening member can be adjusted, or both of the securement and opening members can be adjusted to create openings in the decorative covering. It should further be understood that, in this embodiment, the opening member and the securement member are capable of individual movement.

Restrained positioning of the rows with the securement member can be accomplished in several manners including, but not limited to, fixedly securing with adhesive, ultrasonic welding, knitting, tying or the like, or restricting the movement of the row relative to the securement member with a stop or other like restricting member. For example, the movement of the rows can be restricted by stop mechanisms positioned on the securement member. The opening member, which also connects the head rail and the rows, may be similarly restrainedly positioned.

The transverse margin or longitudinal regions to which the securement members are restrainedly positioned preferably are about either the upper and lower edges of the row, which extend across the width of the window shade. The opening member is restrainedly positioned about the opposite transverse margin or longitudinal regions. If desired, a rigid securement strip can be used to aid in restrainedly positioning the opening and securement members with the rows. Reinforcing strips can also be included along either or both of the opposed longitudinal regions.

Each of the plurality of rows may be comprised of fabric material, such as a single continuous fabric material or a plurality of fabric materials. The panels may also be formed from other materials such as wooden strips or slats. As discussed, each of the rows includes a plurality of spaced row portions, such as a first and a second side region. The first and second side regions may be of equal size, thereby forming a rectangular shape, or may be of different sizes, so as to form a tapered or substantially triangular shape. The rows may also include a stiffened transverse portion, such as by inclusion of a strip member with the first transverse margin, such as a lightweight plastic slat. A bottom rail may also be provided and suspended from the head rail, whereby the plurality of rows are located between the head rail and the bottom rail.

The vertical adjustment mechanisms that are operatively connected to the various opening members and, in some embodiments the securement members, may be similar to mechanisms commonly found in Venetian blind systems for adjusting the position of cords, such as a worm gear assembly fitted within the head rail and manipulable by an operatively connected wand, whereby turning the wand causes, in this case, the opening member to be retracted. Alternatively, a cord lock assembly can also be utilized with the opening member to raise and lower the opening member. As yet another alternative, a power driven or remotely controlled vertical adjustment mechanism can also be utilized to retract or extend the opening member.

As discussed, each of the rows defines a plurality of row portions spaced in a transverse direction. In a preferred embodiment, each of the plurality of opening members is capable of substantially individually raising or lowering the row portion or row portions to which it is restrainedly position. For example, a particular row may include two row portions, such as including the edges of the row. An opening member is secured to each of these row portions. By raising one of the opening members, the row portion with which it is secured is opened substantially independent of the other row portion. In other words, one side of the row is raised, and the other side is not.

Another example of this feature of individually raising row portions is applied to the embodiment where each of the rows has a substantially triangular or tapered shape, thereby, defining a major edge portion and a minor edge portion. In this embodiment, it is preferred that the direction or orientation of the taper alternate from row to row. In so doing, the overall window covering created from the combination of similarly sized and shaped triangular rows is rectangular. A pair of opening members are provided. One of the cords extends down one side of the covering and is restrainedly positioned with every other row on a longitudinal portion about the less tapered or broader side region of the row. As mentioned, this less tapered or broader region defines a major edge portion of a row, and the narrower or more tapered side region of the rows defines a minor edge portion. The other opening member cord is positioned down the opposite side and is restrainedly positioned with the other rows about their respective major edge portions. The alternating rows define two sets of rows, namely, those rows facing in one direction are considered a first set of rows and those facing in the opposite direction are considered a second set of rows. Each set of rows may be individually opened or both sets of rows may be opened. When opened, the decorative covering provides a unique appearance that is unlike the window covering known in the art, which are typically parallel rows. Instead, the tapered or generally triangularly shaped rows, when raised, form a generally criss-crossing pattern.

DESCRIPTION OF THE PREFERRED EMBODIMENTS OF THE INVENTION

Figure 1:
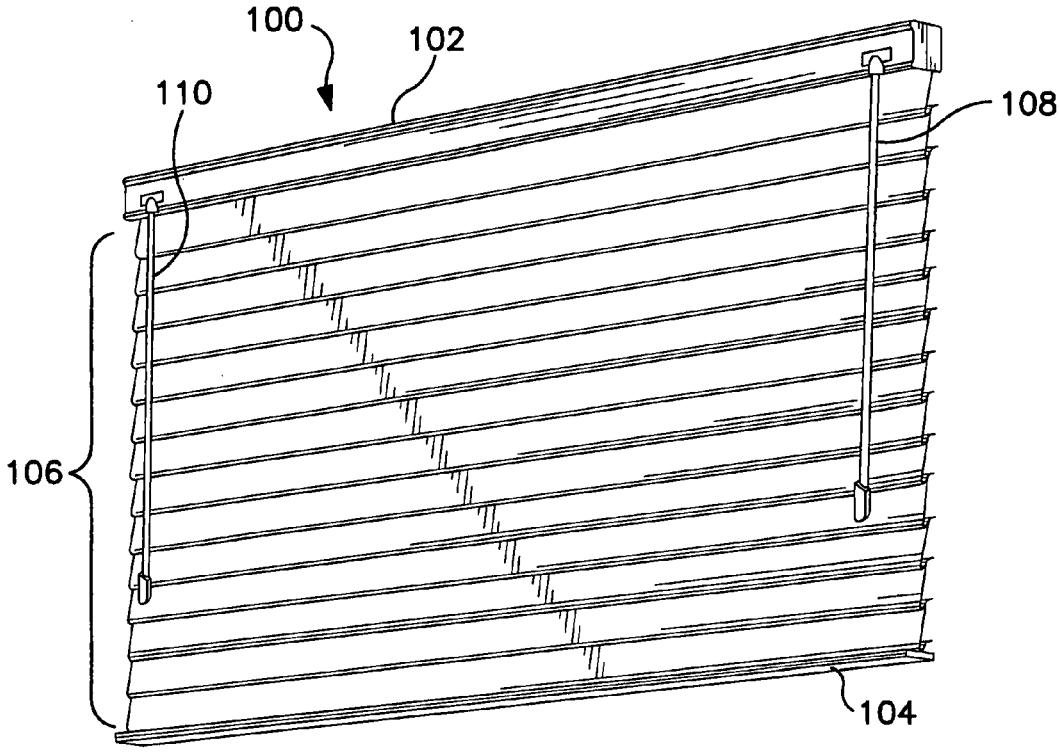
FIG. 1 is a perspective front view of a preferred embodiment of a window covering in a closed position according to the present invention.

The invention disclosed herein is susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

A preferred embodiment of the present invention is shown in FIG. 1. Window shade 100 is shown in a closed position, and includes a head rail 102, a bottom rail 104, and a plurality of rows 106. Also preferably provided is an opening wand 108 for narrowing the profile of individual rows and thereby creating gaps or openings in the overall face of window shade 100, as well as a raising wand 110 for raising the entire shade 100.

Figure 2:
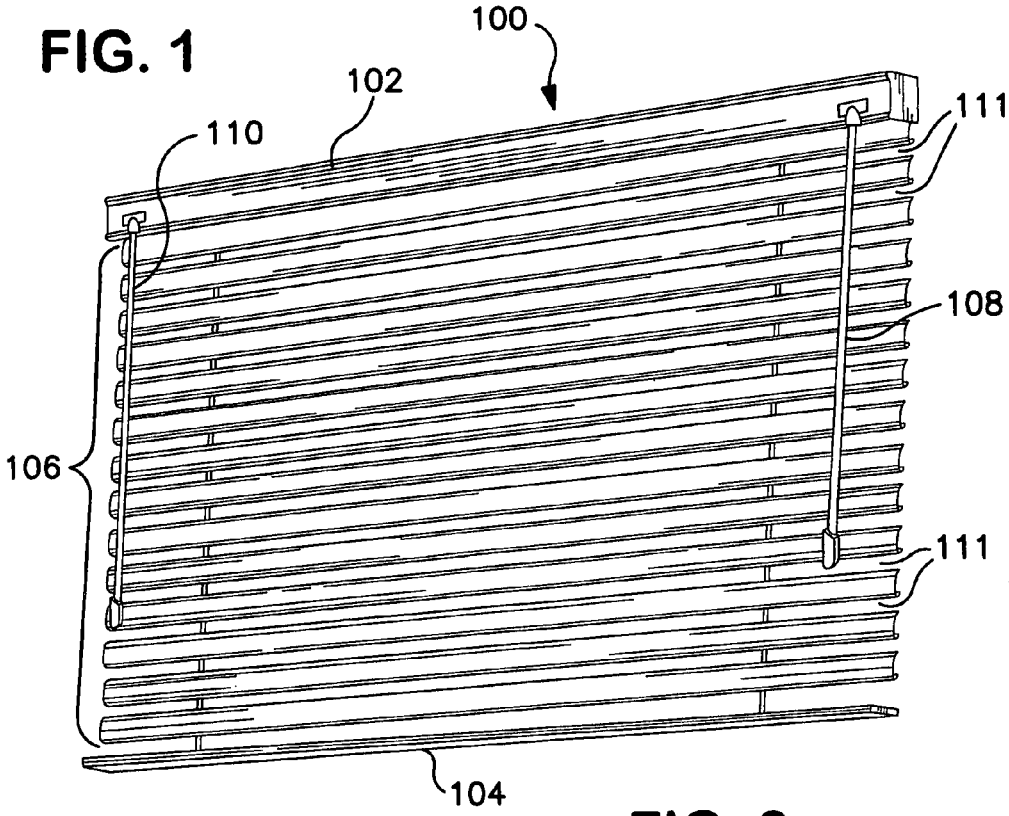
FIG. 2 is a perspective front view of the window covering of FIG. 1 in a partially open position.

In a fully closed state as shown in FIG. 1, the window shade 100 offers an appearance free of connecting cords and provides both privacy and light blocking. If it is desired to allow light into a room without raising the entire shade, and thereby retaining a degree of privacy, a user can rotate the opening wand 108. As the opening wand 108 is rotated, each of the plurality of rows 106 is adjusted to narrow its profile by drawing a portion of the panel behind the face of the particular row such that gaps 111 in the window shade 100 are opened as shown in FIG. 2. Although it is not shown in FIGS. 1 and 2, the vertical adjustment mechanism can be a cord lock as is readily available in the art which enables a person to adjust the position of the cords as desired. The particular procedure for opening each of the plurality of rows is discussed in further detail below.

Figure 3:
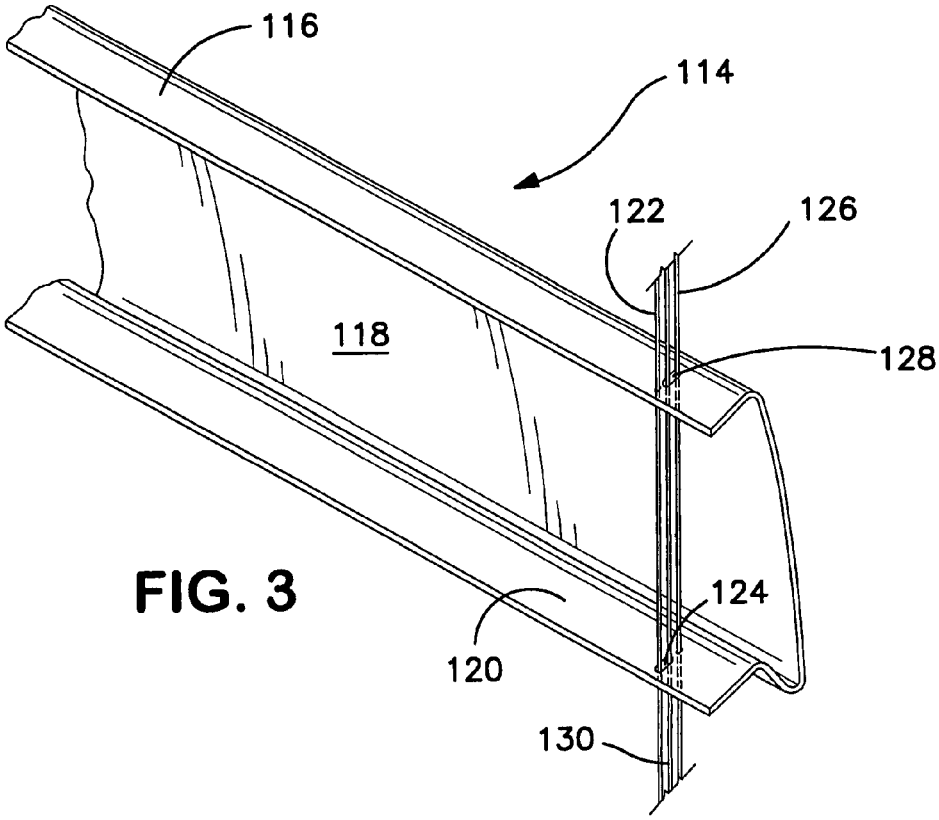
FIG. 3 is a perspective rear view of a preferred embodiment of a row from the window covering of FIG. 1.
Figure 4:
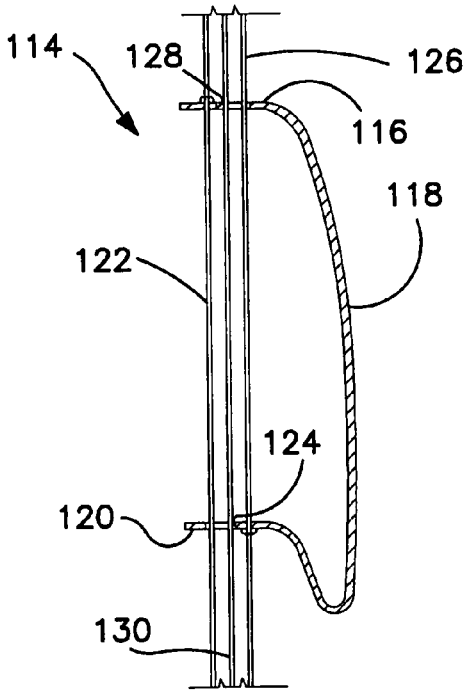
FIG. 4 is a cross sectional view of the row of FIG. 3.

Referring to FIGS. 3 and 4, the narrowing of the longitudinal profile of one of the plurality of rows from the window covering of FIGS. 1 and 2 is explained. In this embodiment, a row 114 is formed of a single panel of fabric having an upper longitudinally extending region 116, a central longitudinally extending region 118, and a lower longitudinally extending region 120. The aggregate of the central region 118 for each of the rows forms the overall face of the window covering. As discussed above, each row may be comprised of multiple pieces of fabric. For example, the upper and lower longitudinally extending regions 116 and 120 could be formed of one type of fabric, whereas the central longitudinally extending region 118 could be a fabric of a different color, opacity, texture or the like.

Passed through the upper region 116 and the lower region 120 is a securement member, such as cord 122, which is secured to the upper region 116 by way of adhesive, ultrasonic welding, knitting, or the like. Cord 122 is passed through a hole 124 defined by the lower region 120, such that cord 122 is not secured to the lower region 120.

An opening member, such as cord 126 is also provided. Cord 126 is passed through hole 128 defined by the upper region 116, and is secured to lower region 120, also by way of adhesive, ultrasonic welding, knitting, or the like. Each of the plurality of rows is similarly secured to the cords 122 and 126. Alternatively, cords 122 and 126 may be passed through holes, but would include stops fixedly secured thereto so as to limit the cords from passing through the holes. For example, annular members such as washer shaped pieces that are positioned and fixed by pinching the annular member on the opening member and securement member can be utilized.

In this embodiment, as opening member, such as cord 126, is retracted by way of a vertical adjustment mechanism (not shown) in the head rail 102 (FIG. 1), which is operatively connected to the opening wand 108 (FIG. 1), the lower region 120 is urged towards the upper region 116, which remains vertically stationary relative to the head rail. The collapsible row 114 is thus folded upon itself to present a narrower longitudinal profile. As shown in FIG. 2, openings 111 are created in the plurality of rows to permit light through without requiring the raising or lowering of the entire window covering 100.

Referring again to FIGS. 3 and 4, a raising member, such as cord 130 for raising the bottom rail 104 and the plurality of rows 106 is also passed through holes 124 and 128 and secured to bottom rail 104. The raising member, such as cord 130, is operatively connected to raising wand 110 (FIG. 1). Although only one set of cords 122, 126, and 130 is shown, it is preferred that two of sets of cords be provided which are equidistantly spaced from opposite edges of the window covering as can be seen in FIG. 2.

Although not shown in the FIGURES, a reinforcing strip may also be included along either the upper longitudinally extending region, the lower longitudinally extending region, or both. This reinforcing strip may be comprised of a thin metal strip, plastic, reinforced material or the like secured to the upper or lower longitudinally extending regions, respectively. Such a reinforcing strip may be included with any of the embodiments disclosed herein.

Figure 5:
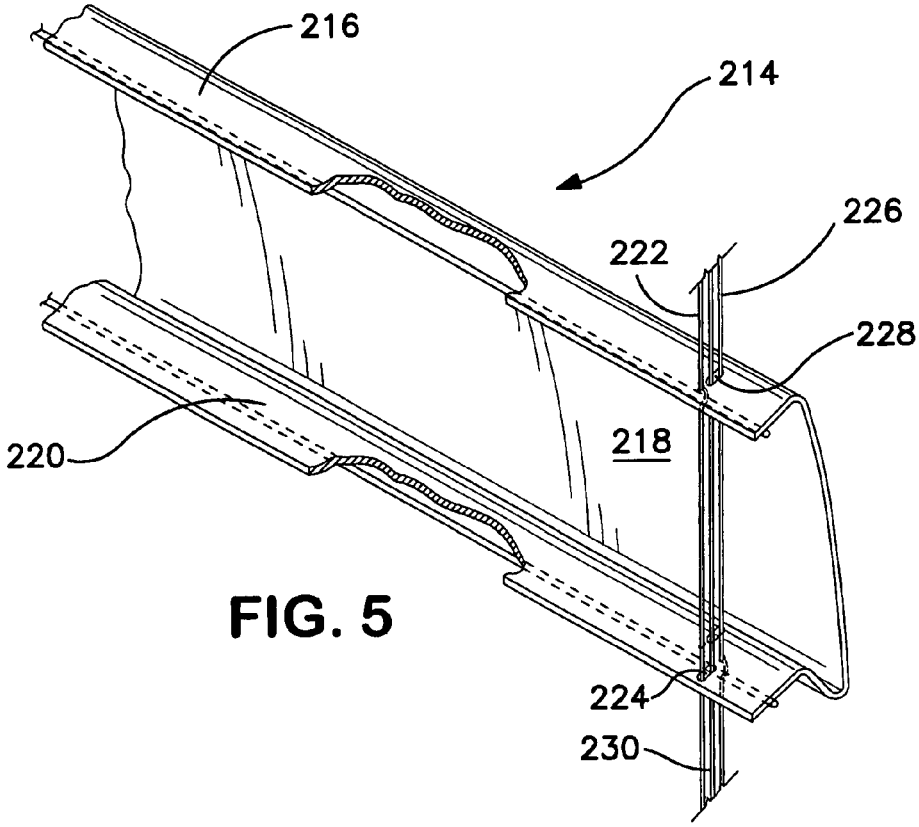
FIG. 5 is an enlarged perspective view of a preferred embodiment of a row with an alternate method of securing the row to the securement member.
Figure 6:
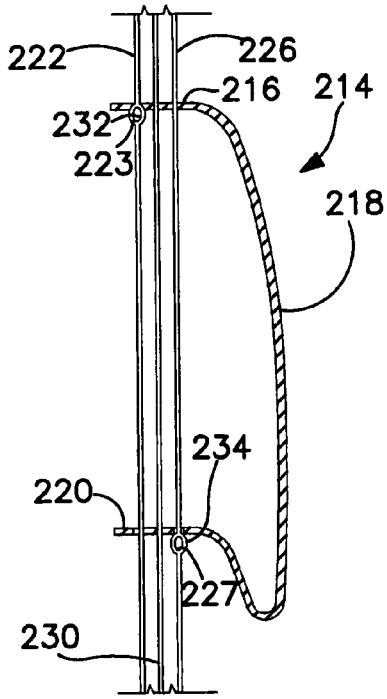
FIG. 6 is an enlarged cross sectional view of the embodiment of FIG. 5.

As discussed above, the securement member and opening member can be restrainedly positioned with the plurality of rows in a variety of ways. Shown in FIGS. 5 and 6 one embodiment utilizes plastic strips. Similar to the embodiment described in FIGS. 3 and 4, a row 214 is formed of a single piece of material having an upper longitudinally extending region 216, a central longitudinally extending region 218, and a lower longitudinally extending region 220. Passed through hole 228 in the upper region 216 and hole 224 in the lower region 220 is a securement member, such as cord 222. Similarly, opening member 226 is passed through hole 228 in the upper region 216 and hole 224 in the lower region 220. Formed with securement member 222 and opening member 226 are loops 223 and 227, respectively. Securement strips 232 and 234 that are preferably formed of plastic are passed through loops 223 and 227, respectively, and are positioned relative to the row 214 as depicted such that the downward movement of the row relative to the securement member 222 and opening member 226 are restricted. If desired, strips 232 and 234 can be fixedly secured to the row 214, such as by an adhesive.

Figure 7:
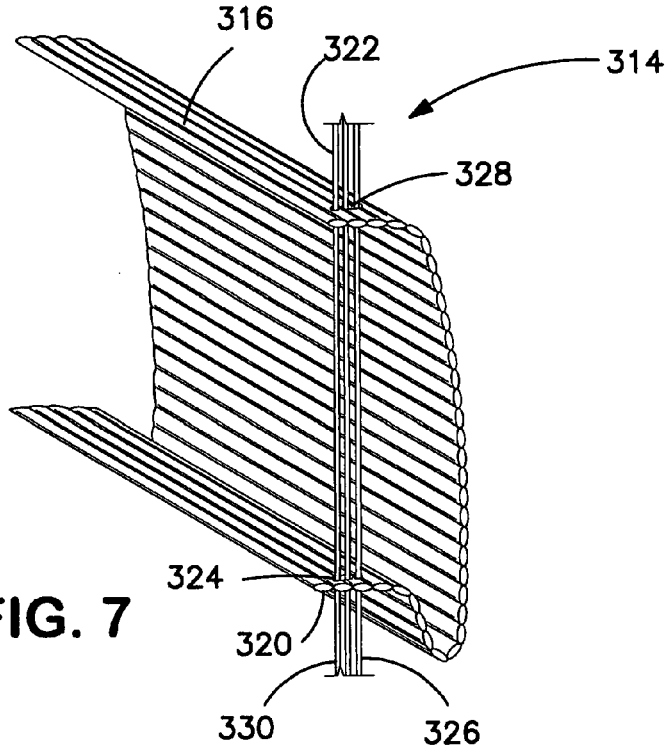
FIG. 7 is a perspective rear view of another alternate embodiment of a row from a window covering according to the present invention.
Figure 8:
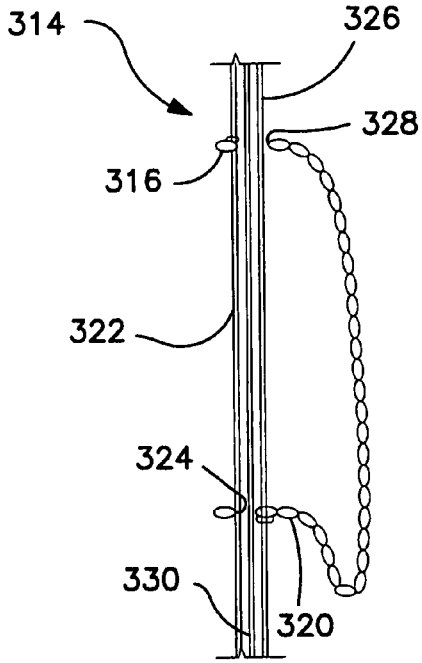
FIG. 8 is a cross section view of the row of FIG. 7.

An alternative of the present invention is shown in FIGS. 7 and 8. In this embodiment, the plurality of rows is comprised of a plurality of rigid slats. Such slats can be relatively wide slats as typically found in wooden Venetian blinds, or as shown, can be relatively narrow strips of decorative wood, such as wicker, rattan or bamboo. A plurality of relatively narrow strips of wood make up the plurality of rows such as row 314. An upper region 316 is provided with the plurality of wood strips, and defines a hole 328. The upper region can be comprised of a single strip or may be a number of strips. A lower region 320 can similarly be formed and also defines hole 324. Passed through the upper region 316 and the lower region 320 is a securement member 322, which is secured to the upper region 316 as described above, and is passed through hole 324 in the lower region 320 and is not secured to the lower region 320. An opening member 326 is passed through hole 328 and secured to lower region 320. A raising member 330 for raising the bottom rail and the plurality of rows as described above with the other embodiments is also passed through holes 324 and 328. Similar to the previous embodiments, a cord 326 is retracted such that lower region 320 is pulled towards upper region 316 to create gaps in the overall face of the window shade.

Figure 9:
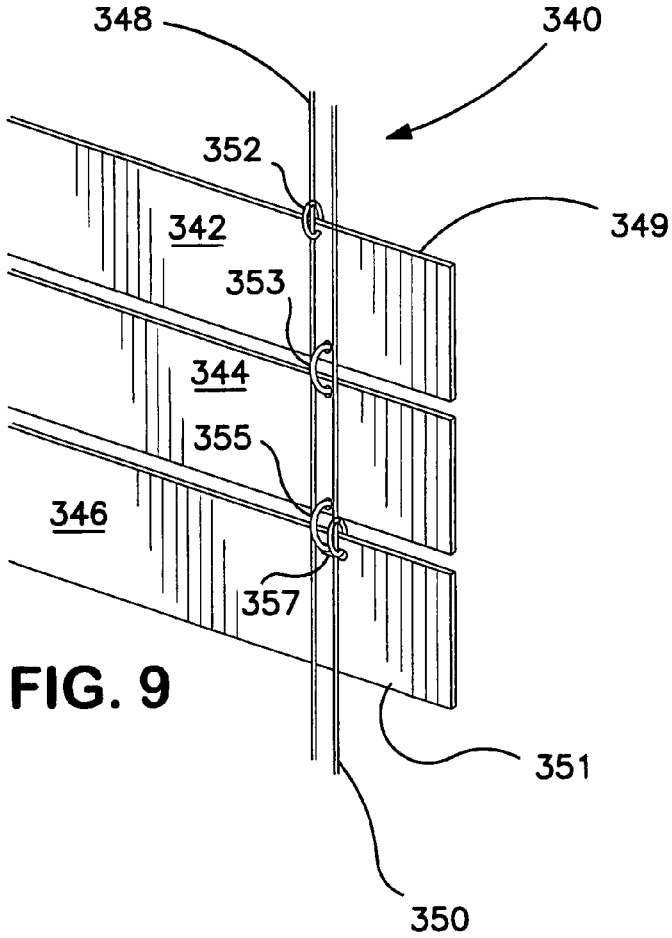
FIG. 9 is a perspective rear view of another alternate embodiment of a row comprising slats from a window covering according to the present invention.
Figure 10:
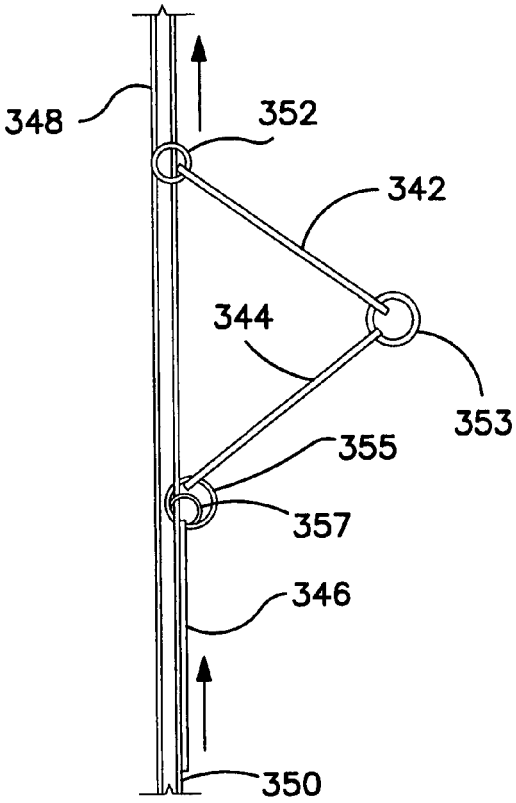
FIG. 10 is a perspective view of the embodiment of FIG. 9, with the slats partially retracted.

Shown in FIG. 9 is an embodiment of the present invention wherein each of the plurality of rows is comprised of slats, such as those typically found in wooden Venetian blinds. In this example, the row 340 is comprised of three slats, 342, 344, and 346, but more slats can be used. Securement member 348 is secured to slat 342 about an upper edge 349 by ring 352. Opening member 350 is secured to slat 346 also about a lower edge 351. In this particular embodiment, rings 353 and 355 connect slats 342, 344, and 346. An additional ring 357 is secured to lowermost slat 346, to which opening member 350 is secured. Referring to FIG. 10, as the opening member 350 is retracted, lowermost slat 346 is pulled upwards, which causes slats 342 and 344 to deflect and fold onto one another.

Figure 11:
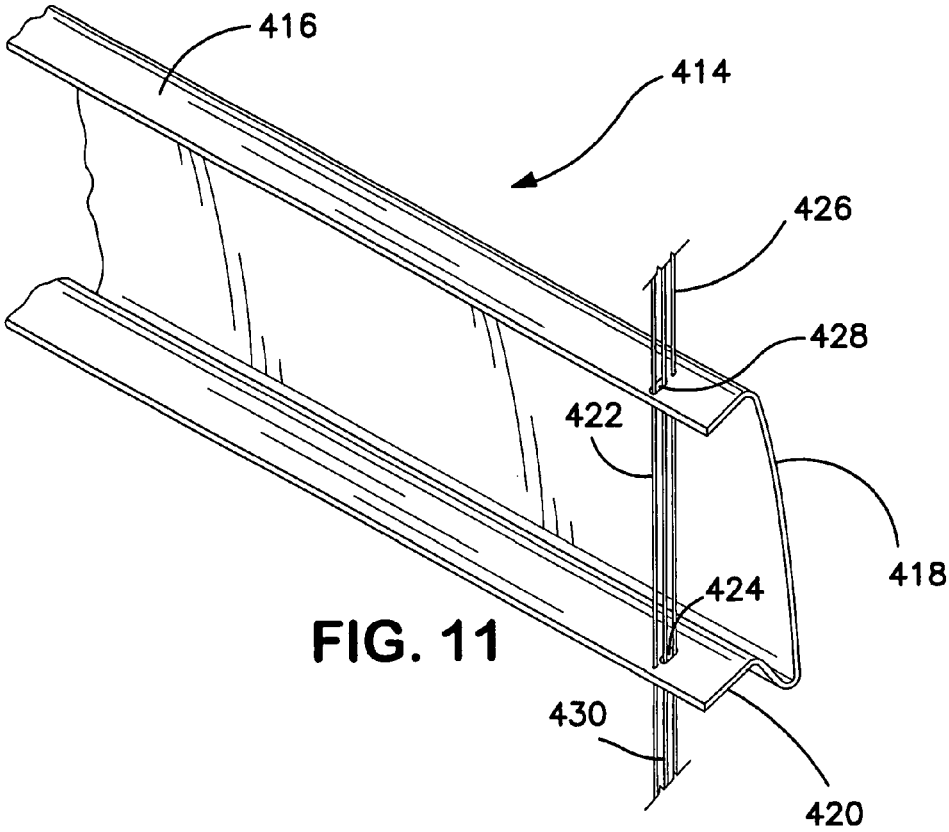
FIG. 11 is a perspective rear view of yet another alternate embodiment of a row from a window covering according to the present invention.
Figure 12:
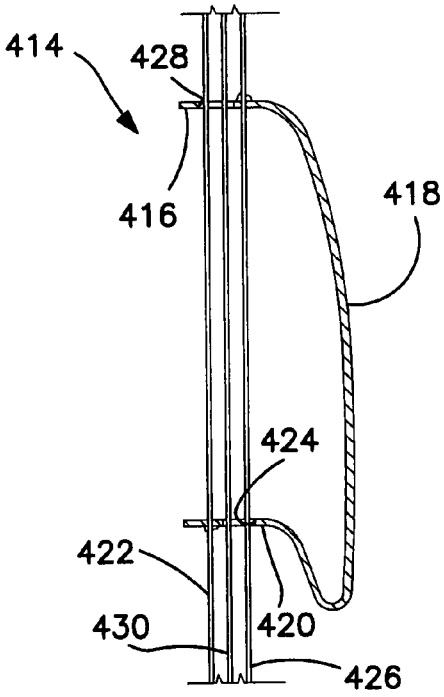
FIG. 12 is a cross section view of the row of FIG. 11.

In each of the embodiments shown thus far, gaps in the face of the window shade, i.e., the open position, have been created by pulling the lower region of a row towards the upper region. It is contemplated, however, that gaps in the face of the window shade can also be created by lowering the upper region towards the lower region, which is held in place: An example of such an embodiment is shown in FIGS. 11 and 12.

In this embodiment, a row 414 is formed of a single piece of fabric having an upper longitudinally extending region 416, a central longitudinally extending region 418, and a lower longitudinally extending region 420. Passed through the upper region 416 and the lower region 420 is a securement member 422, which is fixedly secured to the lower region 420. Securement member 422 is passed through a hole 428 defined by the upper region 416, such that it is not secured to the upper region 416. An opening member is also provided, and is secured to upper region 416. In this embodiment, as opening member 426 is extended by way of a vertical adjustment mechanism in the head rail, the upper region 416 is lowered towards the lower region 420, which is held substantially stationary relative to the head rail by the securement member 422. As such, the collapsible row 414 folds upon itself to present a narrower longitudinal profile. Similar to the previous embodiments, a raising member, such as cord 430 for raising the bottom rail and the plurality of rows is also passed through holes 424 and 428. A similar arrangement whereby the upper region is lowered to the lower region can be utilized in any of the configurations previously described. As discussed above, it is contemplated that the opening member and securement members may be interchangeable and each provide the ability to raise or lower the longitudinal portion respectively secured thereto.

Figure 13:
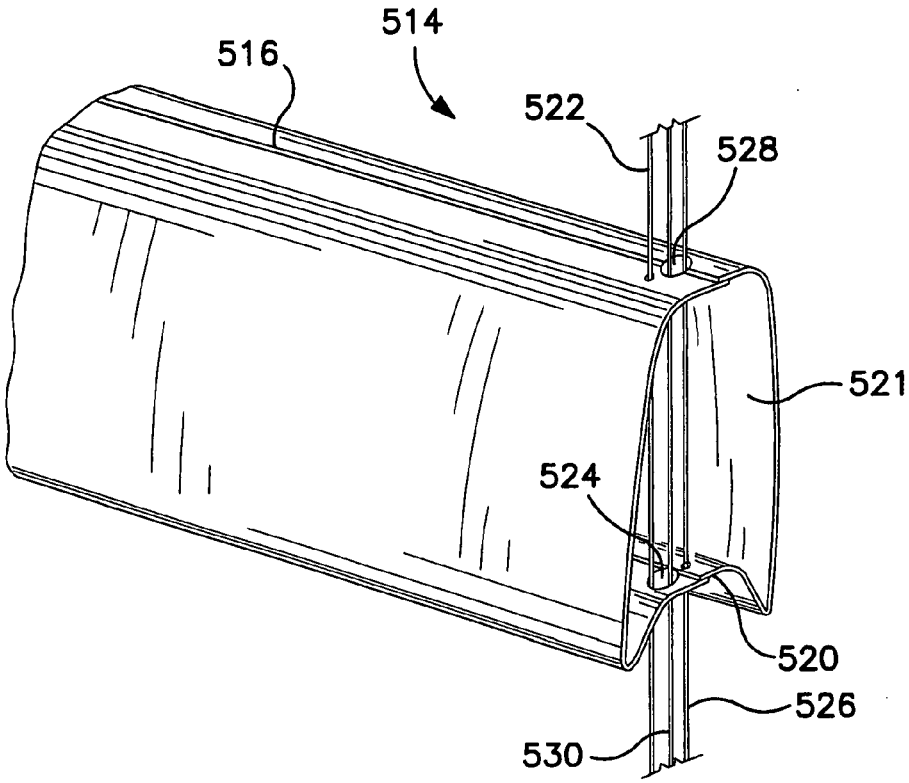
FIG. 13 is a perspective rear view of another alternate embodiment of a row from a window covering according to the present invention.
Figure 14:
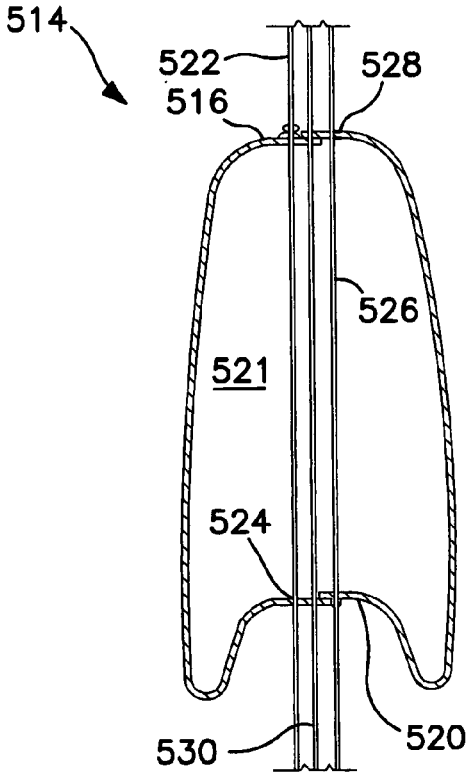
FIG. 14 is a cross section rear view of the row of FIG. 13.

In yet another alternative embodiment, an additional facing can be included in order to provide both a face and back to the window covering that is free of visible cords or connectors when in the closed position. Referring to FIGS. 13 and 14, row 514 is an example of a row that makes up a window covering with a uniform appearance from the face or back of the window covering.

Row 514 is formed of a piece of material having an upper longitudinally extending region 516, a central longitudinally extending face region 518, a central longitudinally extending back region 519 and a lower longitudinally extending region 520. The piece of material may be a single piece of material which is secured to itself to form a continuous piece of material. Alternatively, multiple strips of material can be secured together to form a panel. The multiple strips of material may be the same material, or may be materials having different characteristics, i.e., color, opacity, etc. As shown, row 514 defines a longitudinally extending cell 521.

Passed through the upper region 516 and the lower region 520 is a securement member 522, which is secured to the upper region 516. Securement member 522 is also passed through a hole 524 defined by the lower region 520, such that it is not secured to the lower region 520. An opening member 526 is also provided and is passed through hole 528 defined by the upper region 516, and is also secured to lower region 520. Each of the plurality of rows is similarly formed and secured to the securement member 522 and opening member 526. Preferably, members 522, 526 and 530 are positioned such that equal amounts of material are suspended on either side of the cords. As opening member 526 is retracted the lower region 520 is urged towards the upper region 516, which remains vertically stationary relative to the head rail. As such, cell 521 is collapsed upon itself by bringing the lower longitudinal portion behind the face 518 of the row, and presents a narrower longitudinal profile.

Figure 15A:
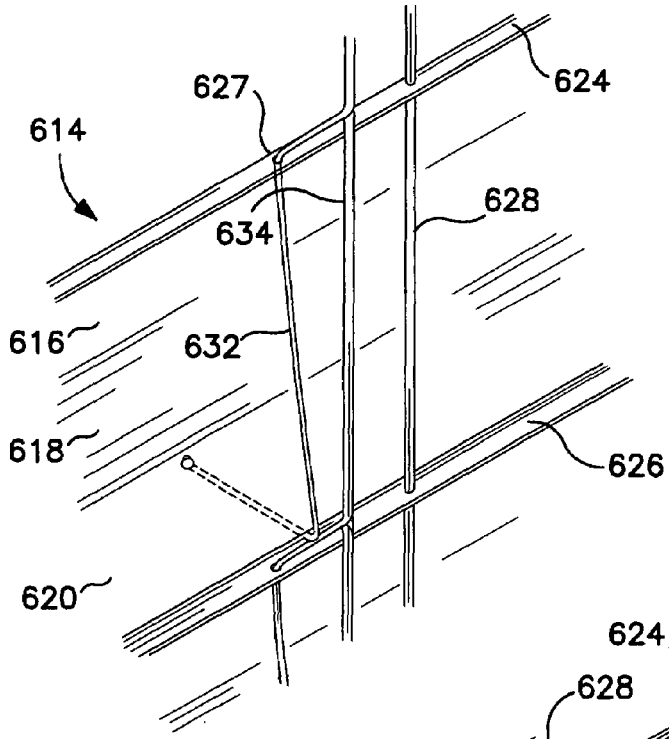
FIG. 15A is a enlarged partial view of FIG. 15.
Figure 15:
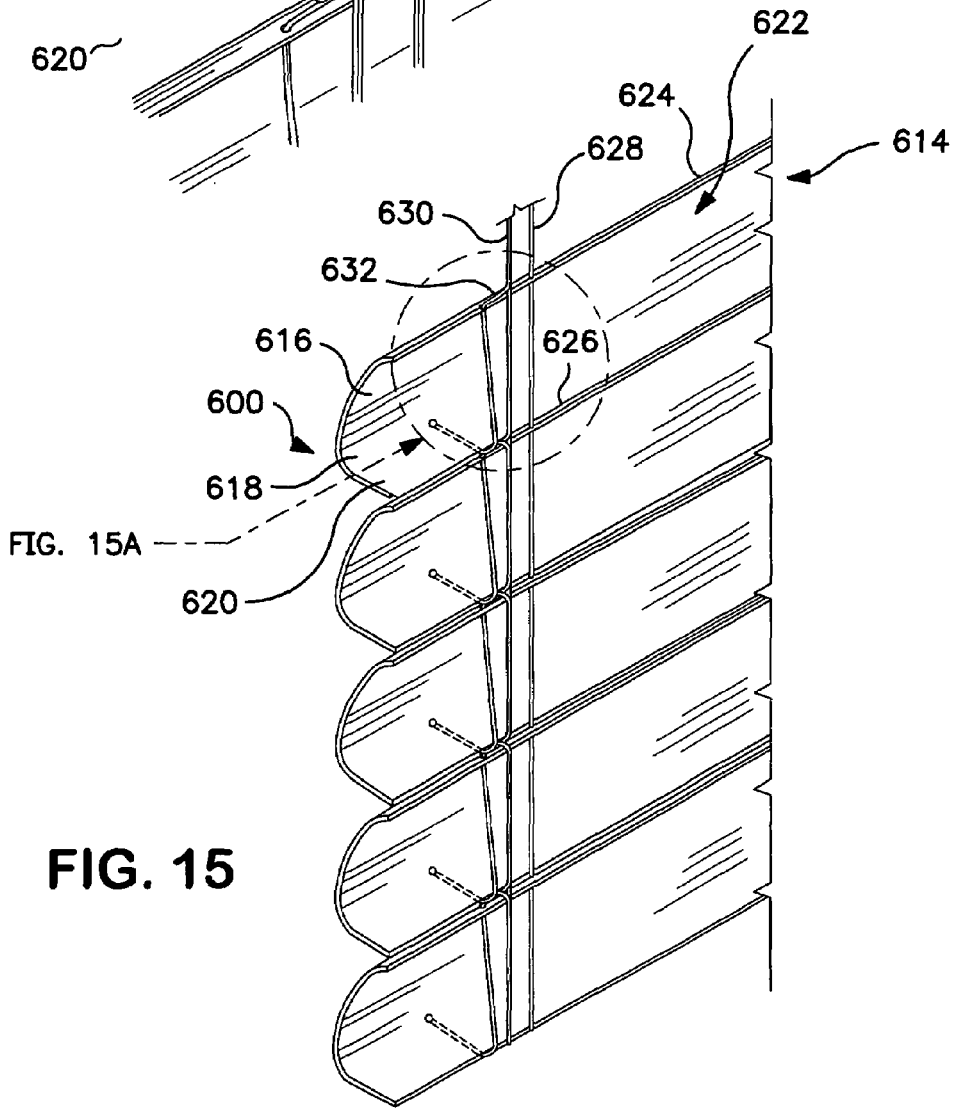
FIG. 15 is a perspective rear view of another alternate embodiment of a row from a window covering according to the present invention.
Figure 16A:
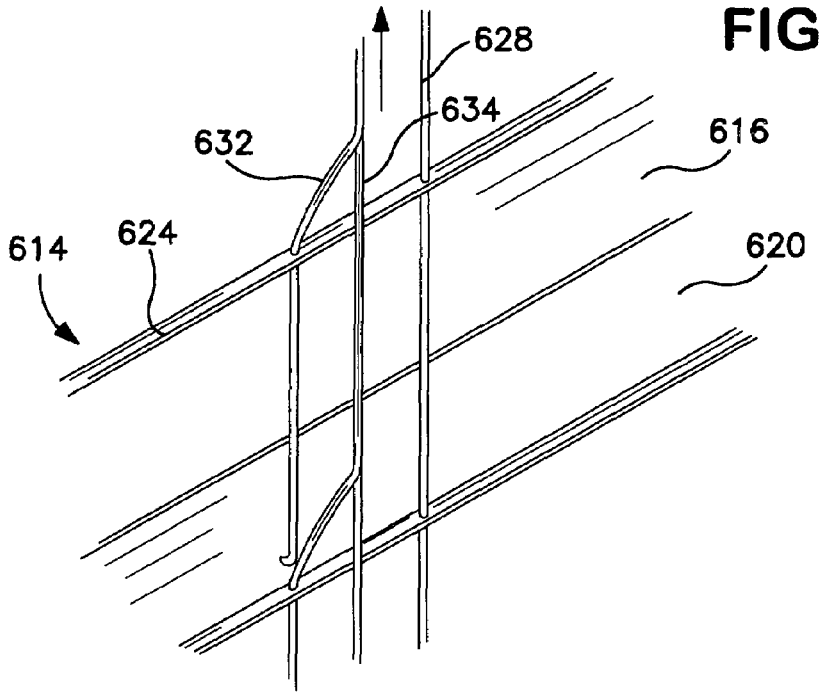
FIG. 16A is a enlarged partial view of FIG. 16.
Figure 16:
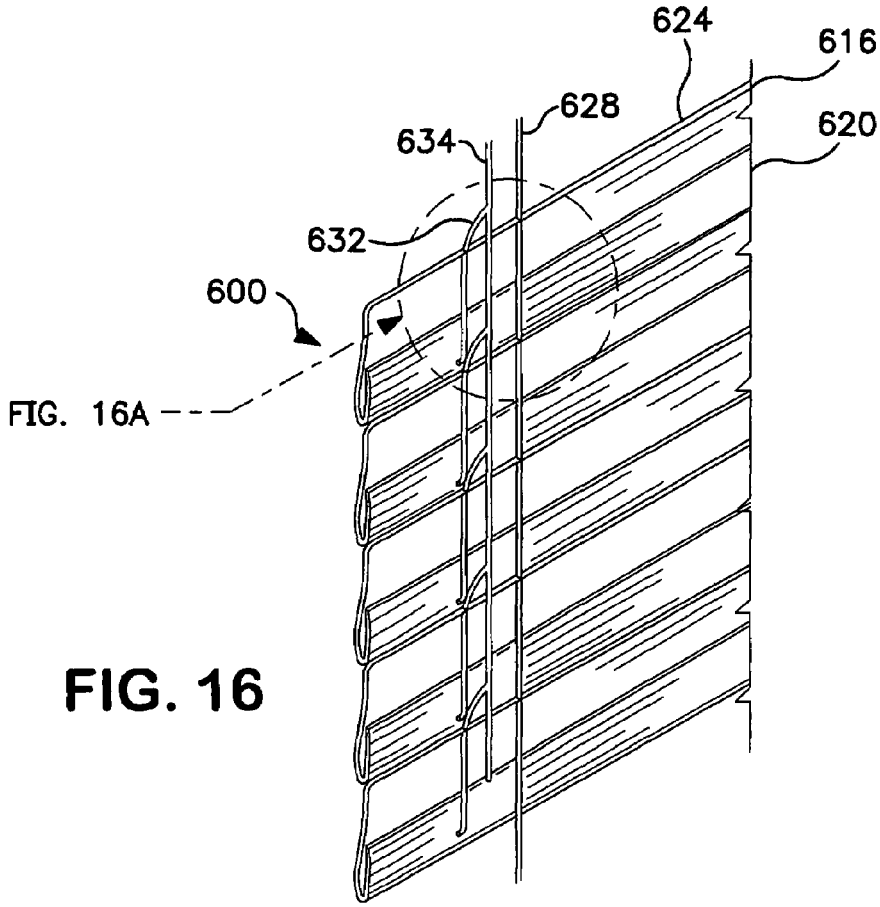
FIG. 16 is a perspective rear view of the row of FIG. 15 with the opening member partially retracted.
Figure 17A:
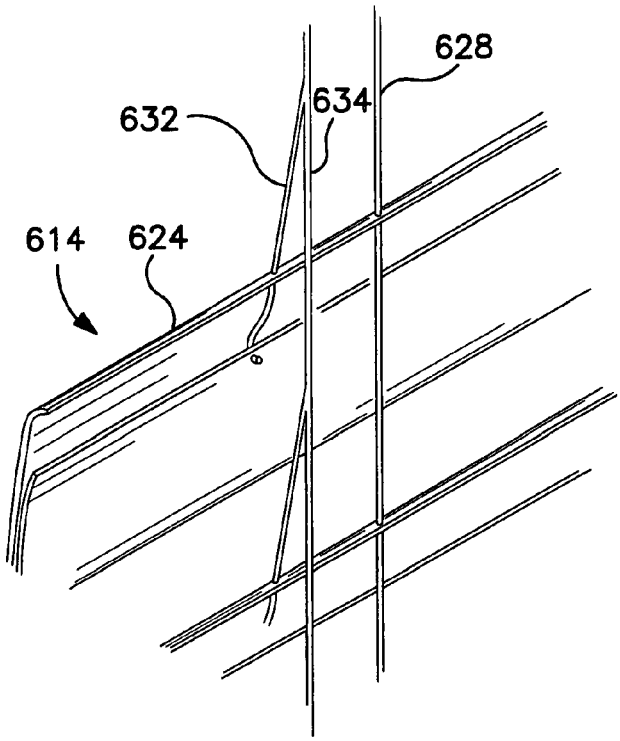
FIG. 17A is a enlarged partial view of FIG. 17.
Figure 17:
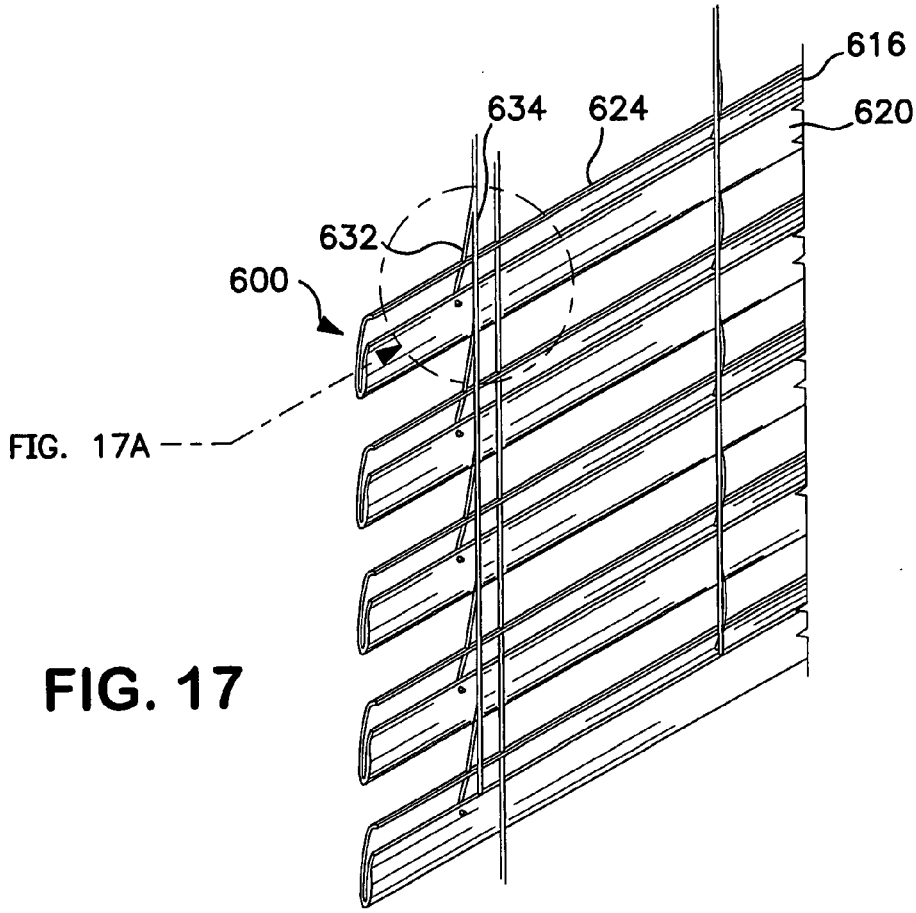
FIG. 17 is a perspective rear view of the row of FIG. 15 fully retracted.

Another embodiment is shown in FIGS. 15 and 15A. In this embodiment, window covering 600 is made of a plurality of rows, such as row 614. Each row is made of a plurality of slats, such as 616, 618, and 620. The row also defines a face (not shown), a rear 622, an uppermost region 624, and a lowermost region 626. As in other embodiments described above, a securement member 628 is restrainedly positioned with the uppermost region 624. An opening member 630 is also provided. In this example, the opening member 630 is comprised of a roll-up member 632 and lifting member 634. The uppermost region 624 defines a hole 627, through which the roll-up member 632 is passed. One end of the roll-up member 632 is connected to the lifting member 634. Preferably, secured to the lifting member 634 are a plurality of roll-up members, one for each row. The roll-up member is passed under the lowermost region 626 of row 614 and is secured to the face of the row 614 about a region adjacent to the lowermost region 626. For example, the roll-up member 632 is secured to the face about a top region of slat 620. As the lifting member 634 is raised, the roll-up member 632 is pulled through the hole 627 such that slat 620 is rolled up as shown in FIGS. 16, 16A, 17 and 17A. As such, gaps are created in the window covering.

Although shown with a row comprising a plurality of slats, the roll-up member can also be used with a row comprised of a fabric material. In order to lessen the visual effect of the roll-up member, it may be comprised of a material similar in color to the row. As shown, the roll-up member may also serve to limit the extent to which the row is extended such that a billowed appearance is achieved.

Figure 18:
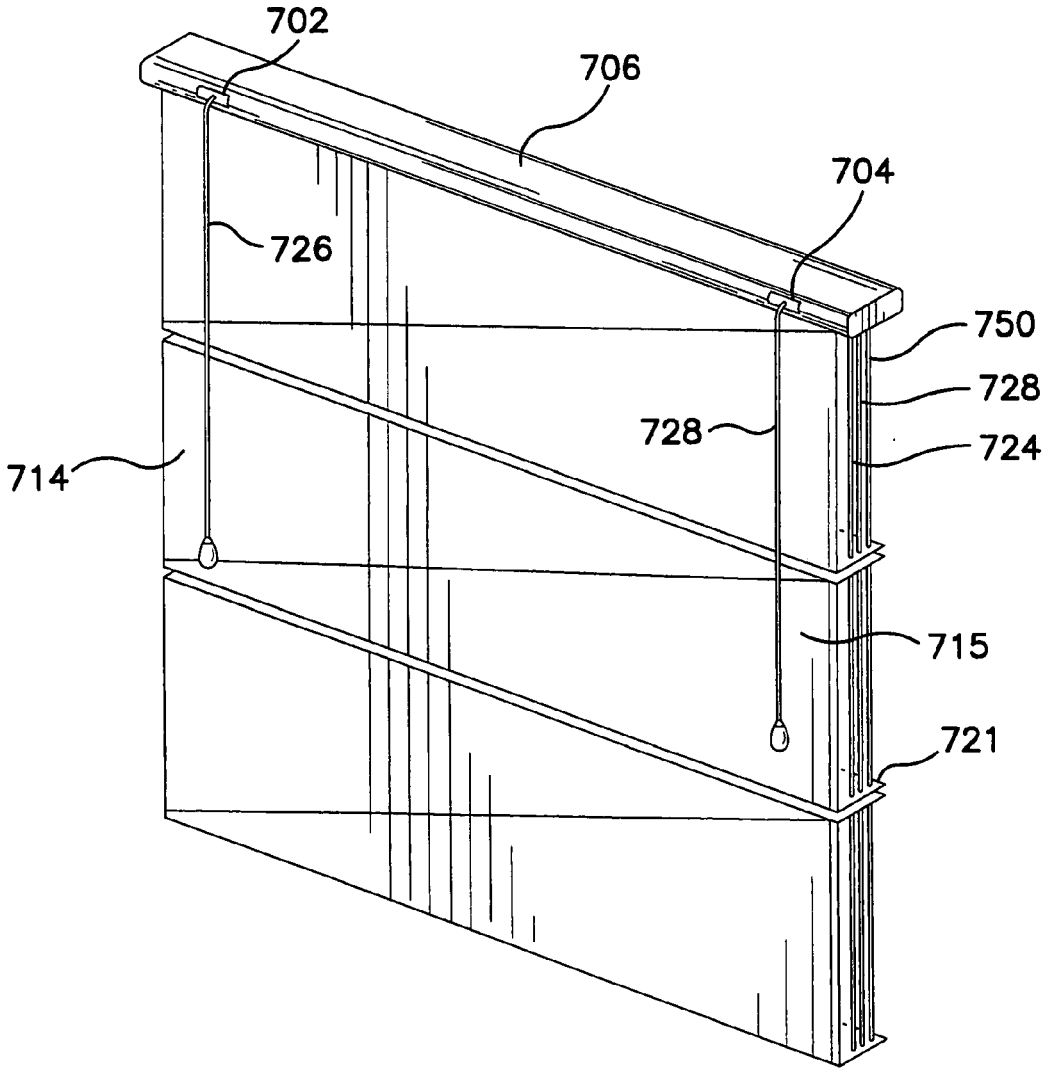
FIG. 18 is a perspective schematic view of another alternate embodiment of the window covering with tapered rows.
Figure 20:
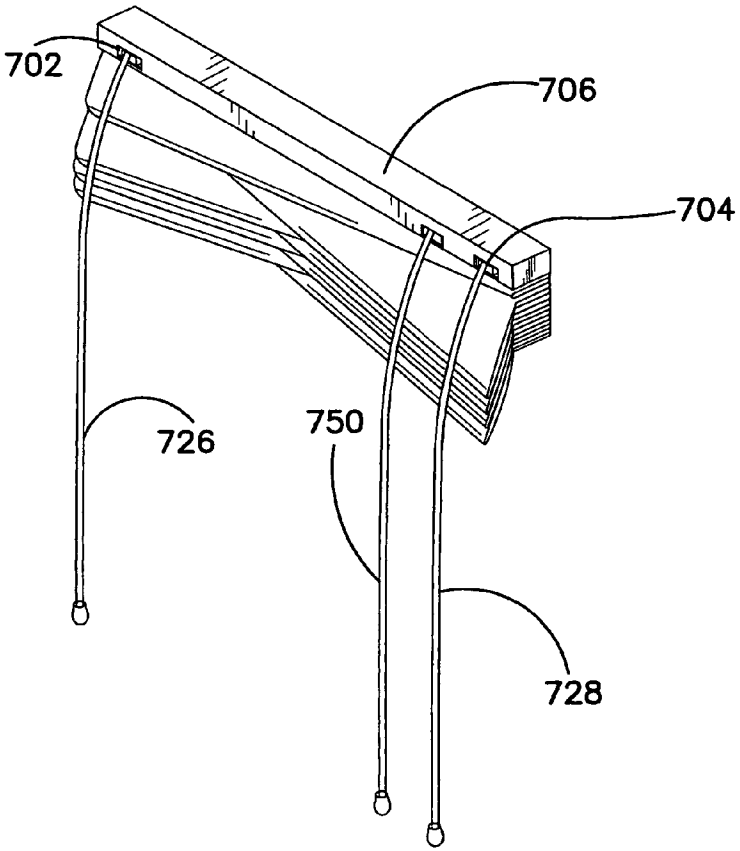
FIG. 20 is a perspective schematic view of the window covering of FIG. 18 with the overall window covering raised.
Figure 19:
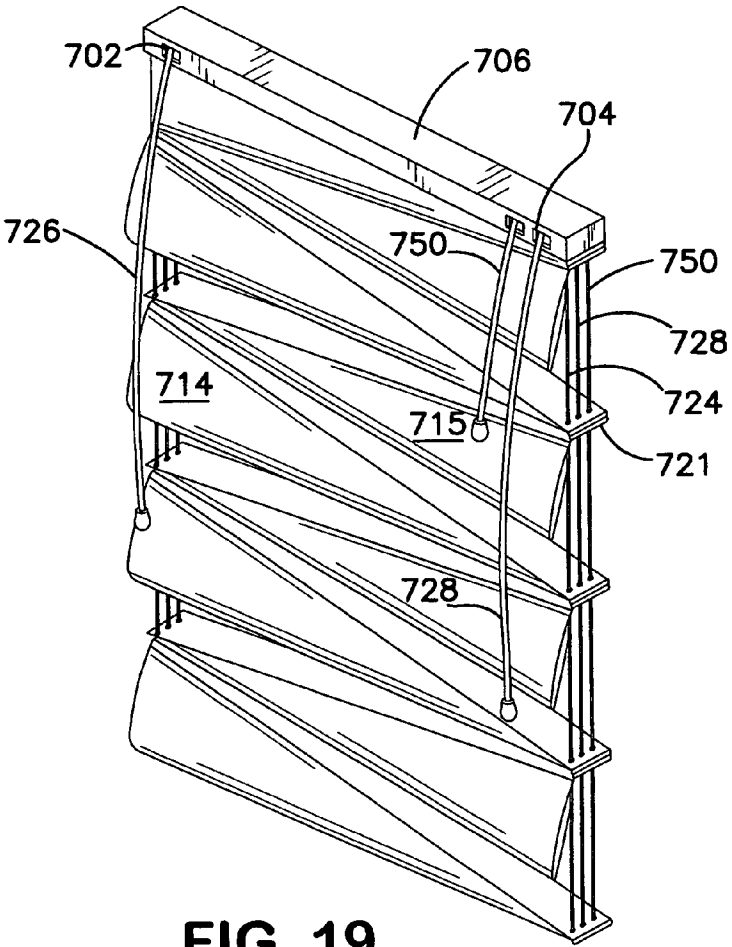
FIG. 19 is a perspective schematic view of the window covering of FIG. 18 with individual rows opened.

FIGS. 18-21 show yet another embodiment of the present invention. As shown in FIG. 18, window covering 700 comprises a plurality of rows, such as rows 714 and 715. Each of rows 714 and 715 are tapered to form a substantially triangular shape. Rows 714 and 715 are adjacent to one another in the overall window covering 700 and are oriented such that the direction in which the rows taper alternates. Those rows oriented in the same manner as row 714 can be considered a first set of rows, and those with the orientation of row 715 a second Set of rows. Opening members, which in this embodiment are shown as cords 726 and 728, are passed through vertical adjustment mechanisms, such as cord locks 702 and 704, respectively, in head rail 706. Securement members, including cord 724, are suspended from the head rail 706 and secured to upper longitudinal regions of the rows, such as upper longitudinal region 717 of row 715. When the opening members 726 and 728 are retracted, openings are created between the individual rows, such as 714 and 715, in the window covering 700 as shown in FIG. 19. A raising cord, such as cord 750 may also be included to raise the overall window covering 700 as shown in FIG. 20. A more detailed explanation of the structure and operation of this embodiment is provided with reference to FIG. 21.

Figure 21:
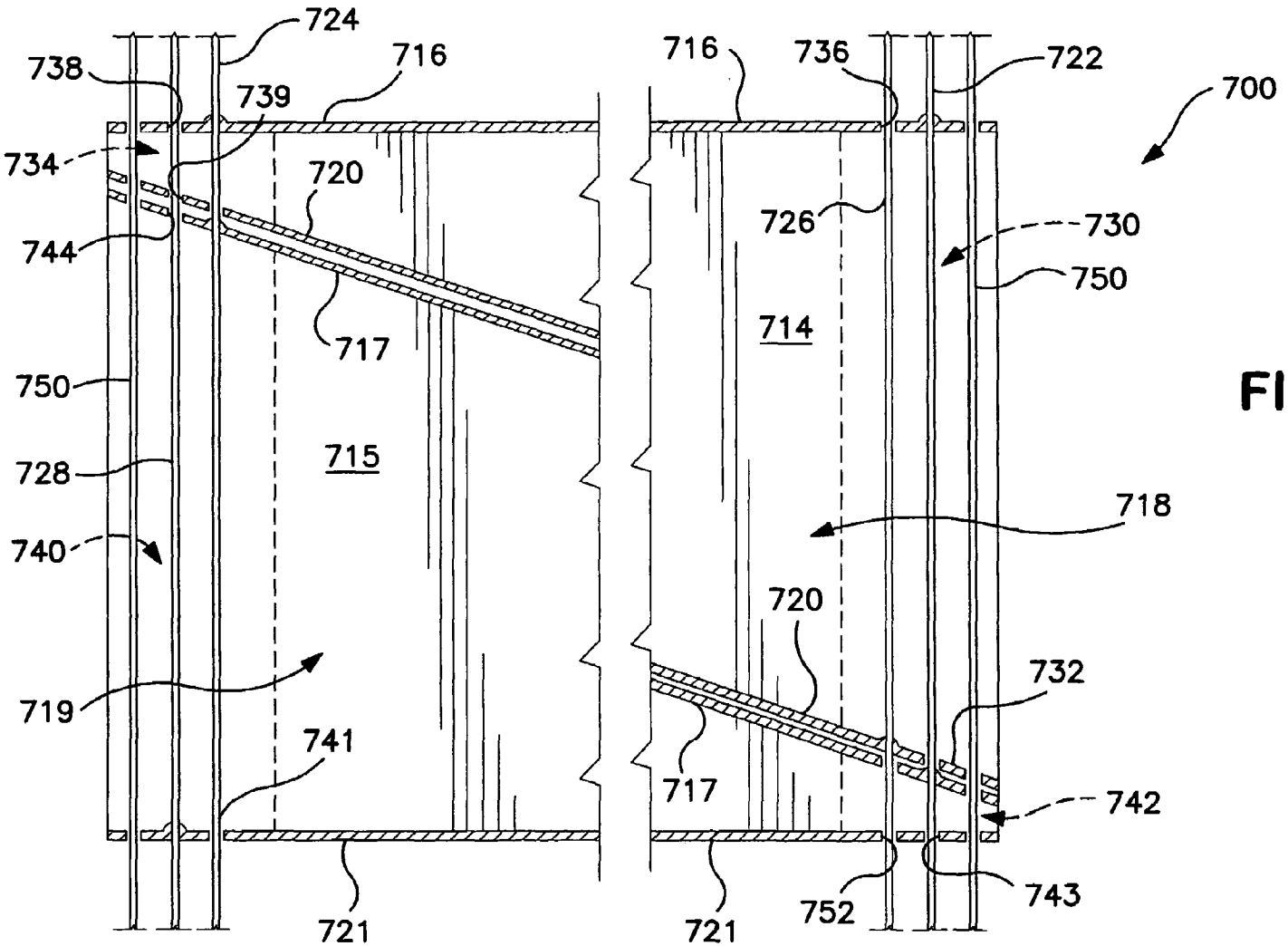
FIG. 21 is a partial rear view, partially in cross section, of the decorative covering of FIG. 18.

Row 714 comprises an upper longitudinally extending region 716, a central longitudinally extending region 718, and a lower longitudinally extending region 720. Similarly, row 715 comprises an upper longitudinally extending region 717, a central longitudinally extending region 719, and a lower longitudinally extending region 721. As with several of the previous embodiments, and as shown previously in FIG. 18, the aggregate of the central regions of the various rows forms the overall face of the window covering. As shown in FIG. 21, rows 714 and 715, are in substantially abutting relationship with one another to minimize any opening in the window shade when the rows are fully extended.

Passed through the upper region 716 and the lower region 720 is a securement member, such as cord 722, which is secured to the upper region 716 about a first lateral edge region or major edge 730 of the row 714 by way of adhesive, ultrasonic welding, knitting, or the like. Cord 722 is passed through a hole 732 defined by the lower region 720, such that cord 722 is not secured to the lower region 720. A second securement member, such as cord 724 is also secured to the upper region 716, but is secured about a second lateral edge region or minor edge 734. In other words, the securement members, such as cords 722 and 724, are preferably substantially evenly spaced from the edges of the decorative window covering 700 so the weight of the material is evenly distributed.

A first opening member, such as cord 726, is passed through hole 736 formed in the upper longitudinal region 716 and about the first lateral region or major edge 730 of row 714, and is secured to the lower longitudinal region 720. A second opening member, such as cord 728 is passed through hole 738 formed in the upper longitudinal region 716, as well as through hole 739 formed in the lower longitudinal region 720. As cord 726 is retracted, or pulled upwards, the lower longitudinal region 720 is drawn up towards the upper longitudinal region 716, thereby creating a gap between rows 714 and 715, and thus an opening in the decorative window covering 700.

Opening and closing row 715 is similarly done. Securement cord member 724 is secured to the upper longitudinal region 717 of row 715 about a first lateral edge region or major edge 740, and is passed through a hole 741 defined by the lower longitudinal region 721 of row 715 about the first lateral edge region 740. The other securement cord member 722 is also secured to the upper longitudinal region 717, and passed through hole 743 defined by the lower longitudinal region 721 of row 715 about a second lateral edge region 742. Opening cord member 728 is passed through hole 744 defined by the upper longitudinal region 717 and secured to the lower longitudinal region 721 about first lateral edge region or major edge 740. Opening cord member 726 is passed through hole 752 in the lower longitudinal region 721. As cord 728 is retracted or raised, the lower longitudinal region 721 to which cord 728 is secured is drawn up towards the upper longitudinal region 717, to create an opening in the covering 700.

In independently raising either opening member 726 or 728, the row portion comprising the major edges 730 or 740, respectively, are raised substantially independent of minor edges 734 and 742. In other words, as opening member 726 is raised and the portion of the row including major edge 730 is drawn upwards, the minor edge 734 is not similarly drawn upwards.

As with the previous embodiments, each of the opening members 726 and 728 may be retracted or extended as is known in the art. For example, cords may be pulled through a cord lock to the desired position as shown in FIG. 18. Alternatively, a drum (not shown) in the head rail operatively connected to a wand may be used to wind or unwind cord. Preferably, opening members 726 and 728 are capable of being operated independently of one another.

In order to raise the overall window covering 700, a raising member, such as cord 750 is passed through the rows and secured to a lowermost row or preferably a bottom rail (not shown). When cord 750 is retracted, such as through pulling cord 750 through a cord lock mechanism, the rows of the overall window covering 700 are raised as shown in FIG. 20.

Figure 22:
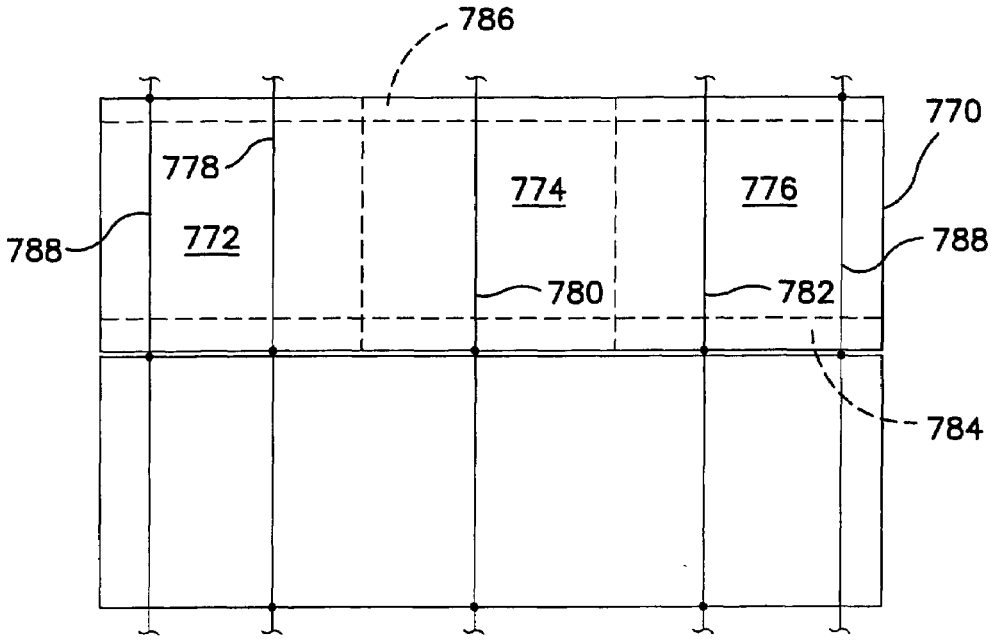
FIG. 22 is a schematic rear view of another embodiment of a decorative covering of the present invention.
Figure 23:
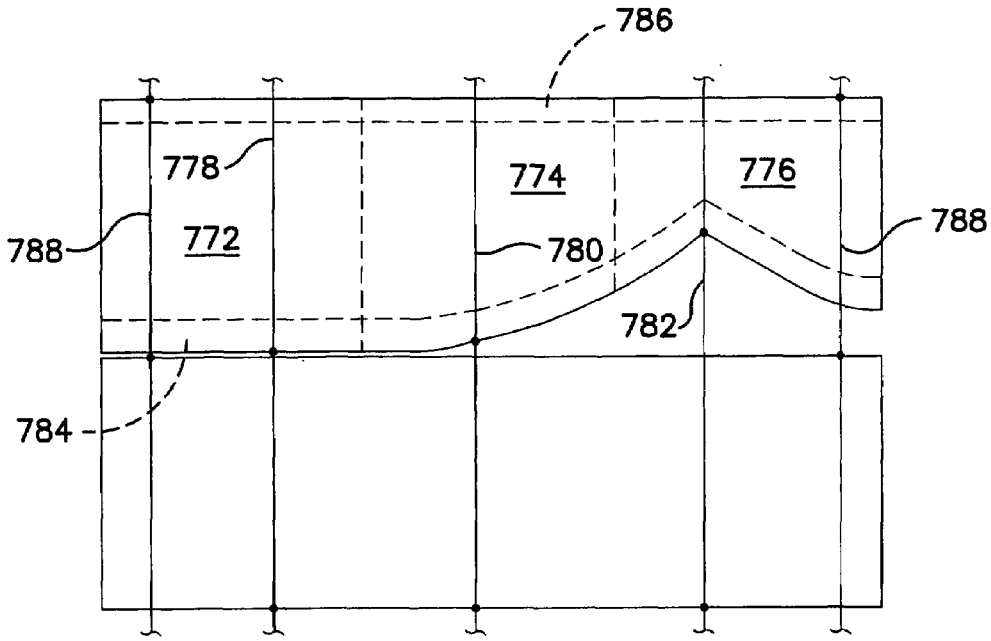
FIG. 23 is a schematic rear view of the embodiment of FIG. 22 a row portion raised.

Yet another embodiment of the feature wherein the particular portions of a row are individually opened is explained with respect to FIG. 22. In this embodiment, row 770 is provided as an example. Row 770 defines a plurality of row portions, such as row portions 772, 774 and 776. To each of these row portions is secured an opening member, such as cords 778, 780, and 782, about the lower longitudinal region or transverse margin 784. Preferably, each of these opening members cords or individually movable. However, it may be desired to have certain row portions moved in concert with one another by having certain opening members be simultaneously controlled. Row 770 is also secured about the upper longitudinal region or transverse margin 786 to a pair of securement member cords 788. As shown in FIG. 23, as opening member cord 782 is raised, cords 778 and 780 remain stationary, so that row portion 776 is raised substantially independent of row portions 772 and 774.

As in previous embodiments, rather then passing the cords through holes formed in the rows themselves, attachment members, such as rings can be utilized. Also, rather then securing the cords as discussed, the cords may be restrainedly positioned through any of the methods discussed above.

Figure 24:
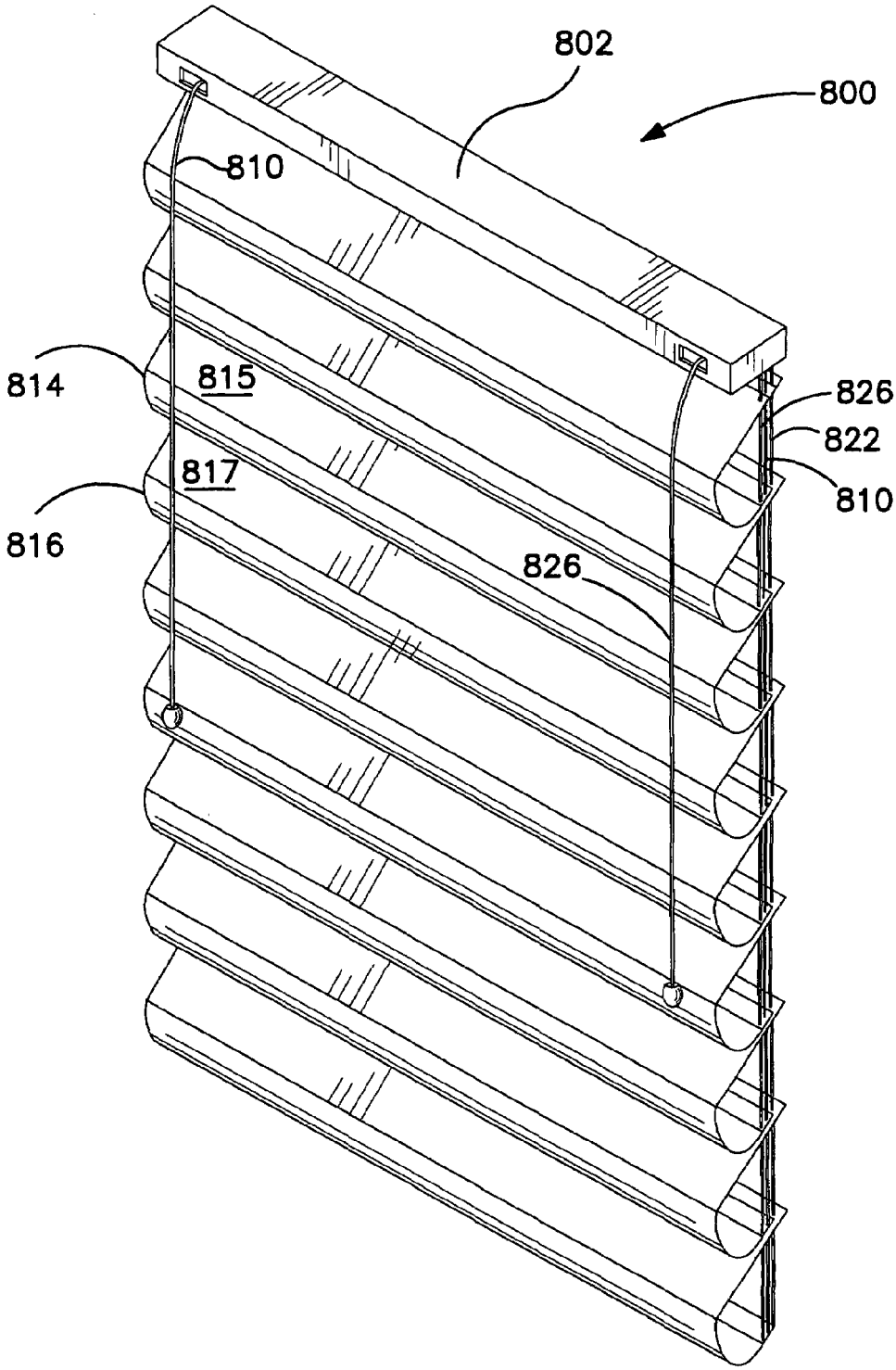
FIG. 24 is a perspective view of another embodiment of a decorative covering of the present invention.
Figure 25:
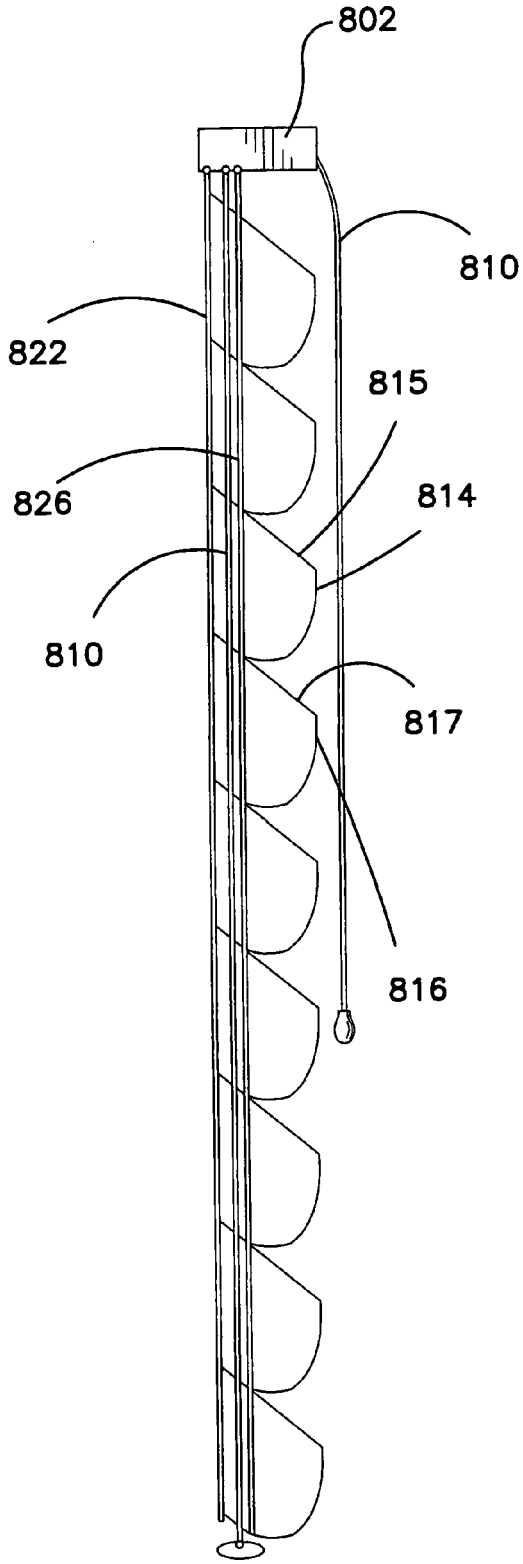
FIG. 25 is a side elevated view of the decorative covering of FIG. 24.
Figure 26:
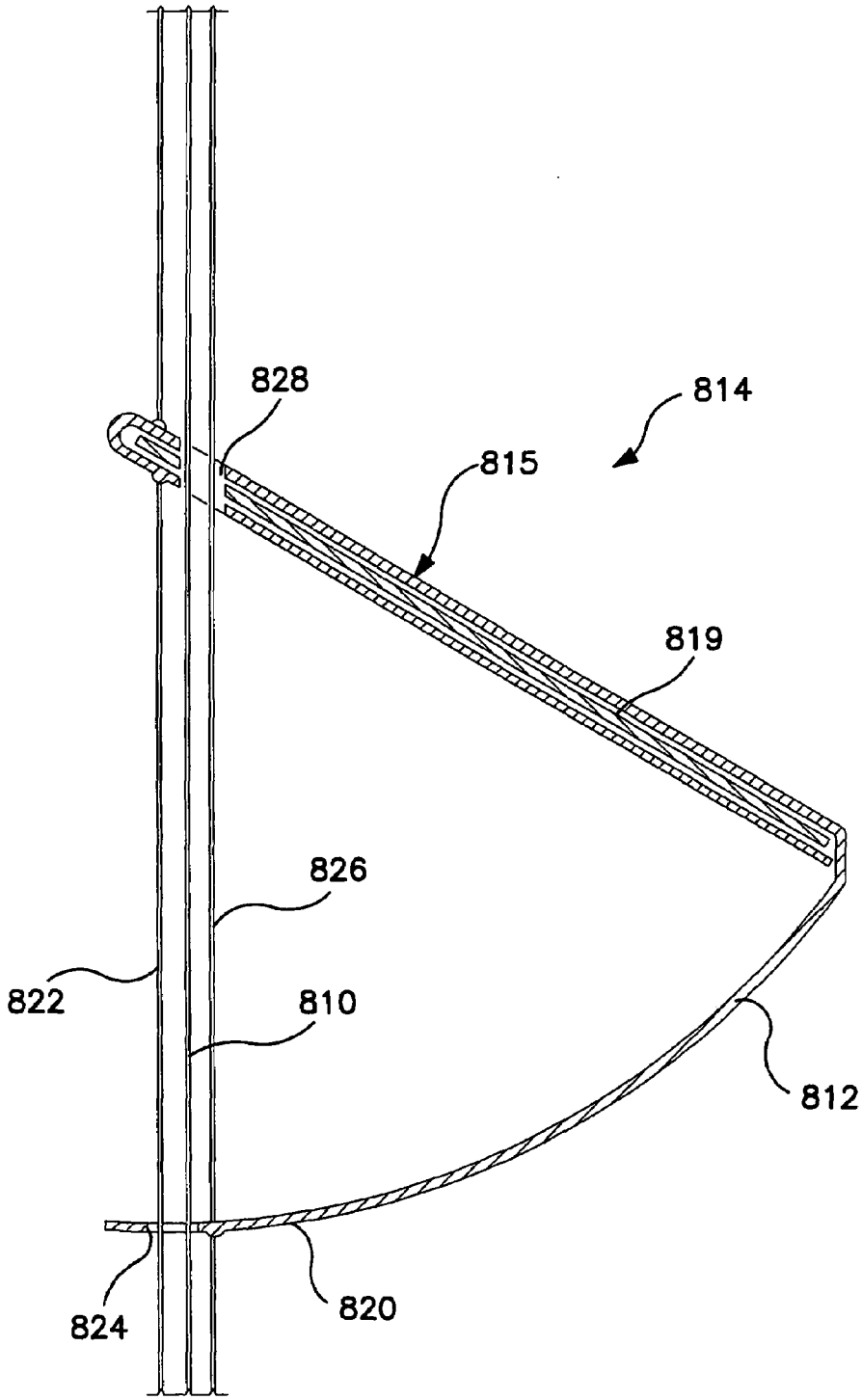
FIG. 26 is a cross sectional view of a row of FIG. 24.

Shown in FIGS. 24-26 is an additional alternative embodiment of the window covering of the present invention. The basic structure of this embodiment is similar to that discussed above with respect to FIG. 3. As shown in FIGS. 24 and 25, window shade 800, which is shown in a closed position, includes a head rail 802 and a plurality of rows comprising panels, such as rows 814 and 816. Also preferably provided is an opening cord 826 for narrowing the profile of the rows and thereby creating gaps or openings in the overall face of window shade 800. Also shown is a raising cord 810 for raising the entire shade 800. Window covering 800, however, includes an additional feature. Each of the rows of window covering 800, such as rows 814 and 816, have stiffened top portions 815 and 817, respectively.

There are various ways for providing the stiffened top portion of a row. These include using a non-woven fabric or slat, using a fabric adhered to the top portion, treating the top portion of the row with a stiffening agent, or the like. Use of a stiffened upper portion provides a unique aesthetic appearance to the decorative covering.

The incorporation of a slat is described in further detail in FIG. 26 with respect to row 814 from FIG. 24. As shown, row 814 comprises a strip of material 812 and a slat member 819. Strip 812 is folded over itself and slat member 819 is sandwiched between the overlapping portions of material 812. Slat member 819 may be fixedly positioned between the overlapping portion of 812 by way of an adhesive.

Passed through the upper region 815 and the lower region 820 of row 814 is a securement member, such as cord 822, which is secured to the upper region 815 by way of adhesive, ultrasonic welding, knitting, or the like. Securement cord 822 is passed through a hole 824 defined by the lower region 820, such that cord 822 is not secured to the lower region 820. An opening member, such as cord 826 is also provided. Cord 826 is passed through hole 828 defined by the upper region 815, and is secured to lower region 820, also by way of adhesive, ultrasonic welding, knitting, or the like.

Figure 27:
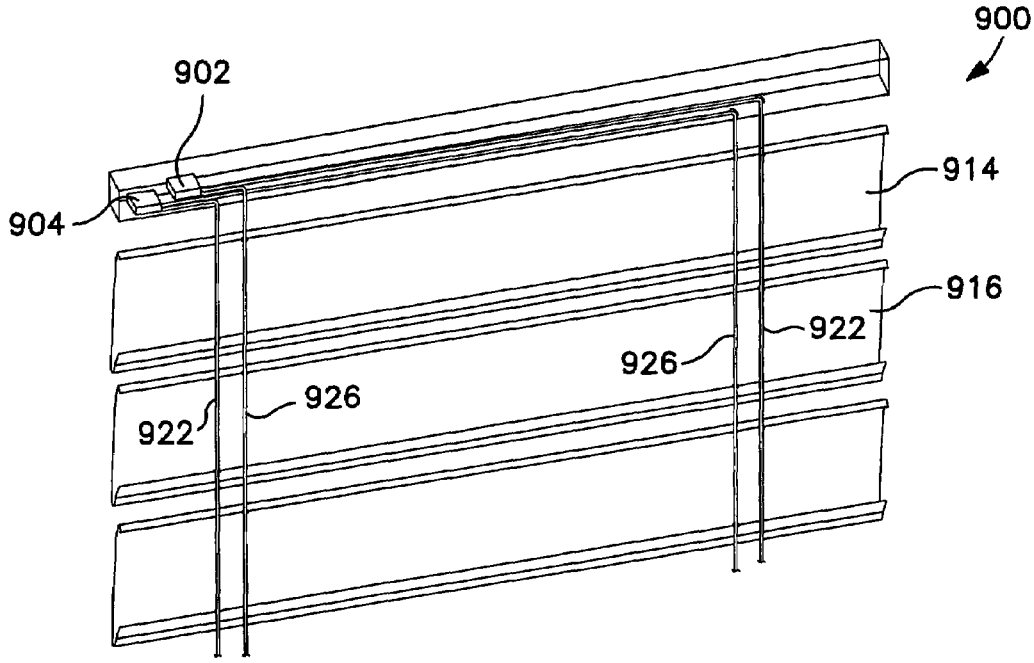
FIG. 27 is a rear view of another embodiment of the a decorative covering of the present invention, with a head rail depicted in phantom.

One alternative feature of the claimed invention that may be incorporated into any of the embodiments is the use of securement members that are independently operable. This is explained with reference to FIG. 27. Window covering 900 includes a plurality of rows, such as rows 914 and 916. Each of the rows, in this embodiment of the window covering, is secured to a pair of opening members 926 and pair of securement members 922. The pair of opening members 926 are operatively connected to an adjustment mechanism shown schematically as 902. Similarly, the pair of securement members 922 are operatively connected to a second adjustment mechanism, such as that shown schematically as 904. As such, the securement members 922 and opening members 926 may be adjusted to raise or lower the transverse region of the rows to which they are secured individually.

The foregoing descriptions are to be taken as illustrative, but not limiting. Still other variants within the spirit and scope of the present invention will readily present themselves to those skilled in the art.

What is claimed is:

1. A window shade comprising:

a head rail, a plurality of collapsible rows suspended from the head rail, a plurality of securement members, and a plurality of opening members;

each of the plurality of rows extending in a transverse direction and having a first transverse margin, and a second transverse margin;

the plurality of securement members being restrainedly positioned with each of the plurality of rows at the first transverse margin of each row;

at least one of the plurality of rows comprising a major edge portion and a minor edge portion, wherein when the row is in a closed position, the row narrows from the major edge portion to the minor edge portion;

the at least one of the plurality of rows further being restrainedly positioned with a first of the plurality of opening members at the second transverse margin; and a first vertical adjustment mechanism operatively connected to the first opening member, the first vertical adjustment mechanism enabling the first opening member to open or close the row restrainedly positioned therewith.

2. The window shade of claim 1, further comprising a second adjustment mechanism operatively connected to the plurality of securement members to enable the securement members to be controllably moved to open or close the plurality of rows restrainedly positioned therewith.

3. The window shade of claim 2, wherein all of the plurality of rows are restrainedly positioned with the first opening member.

4. The window shade of claim 2, wherein each of the opening members and the securement members are independently movable to narrow the plurality of rows.

5. The window shade of claim 1, wherein each of the plurality of rows comprises a major edge portion and a minor edge portion, wherein when the row is in a closed position, the row narrows from the major edge portion to the minor edge portion and wherein the plurality of rows are alternatingly oriented to define a first set of rows and a second set of rows.

6. The window shade of claim 5, wherein the first opening member is restrainedly positioned with the first set of rows at a first set of major edge portions and a second opening member is restrainedly positioned with the second set of rows at a second set of major edge portions.

7. The window shade of claim 1, wherein at least one of the opening members and the securement members is a cord.

8. The window shade of claim 1, wherein at least one of the opening members and the securement members is a strip of material.

9. The window shade of claim 1, wherein the first vertical adjustment mechanism enables moving the opening member independent of the securement member.

10. A window shade comprising:

a plurality of shade rows comprising a first set of rows and a second set of rows, each of the shade rows extending in a transverse direction and defining a plurality of row portions;

an operating mechanism comprising a plurality of opening members, including at least a first opening member and a second opening member and a securement member;

the securement member being secured to each of the shade rows;

the first opening member being secured to a first row portion of the first set of shade shows;

the second opening member being secured to a second row portion of the second set of shade rows;

the first row portion and the second row portion disposed on opposed lateral row edges;

wherein each of the first set of shade rows defines a first major edge portion and a first minor edge portion such that the first set of rows narrow from the first major edge portion to the first minor edge portion in a first transverse direction, and each of the second set of shade rows defines a second major edge portion and a second minor edge portion such that the second set of rows narrow from the second major edge portion to the second minor edge portion in a second transverse direction; and actuation of the operating mechanism raising at least the first opening member to raise the first row portion substantially independent of the second row portion.

11. The window shade of claim 10, wherein the first set of shade rows is secured to the first opening member at the first major edge portion, and the second set of shade rows is secured to the second opening member at the second major edge portion.

12. The window shade of claim 10, wherein any of the first and second opening members and the securement member are cords.

13. The window shade of claim 10, wherein the any of the first and second opening members and the securement member are strips of material.

14. The window shade of claim 10, wherein at least one of the plurality of rows includes a stiffened longitudinal portion.

15. The window shade of claim 14, wherein the stiffened longitudinal portion comprises a slat member.

16. A window shade comprising:

a plurality of shade rows, each of the shade rows defining a transverse direction and defining a plurality of row portions along the transverse direction;

the shade rows being operatively connected to an operating member for raising and lowering the at least one row portion substantially independent of other row portions, the operating member comprising a first opening member secured to the at least one row portion, and a plurality of securement members secured to the row; and wherein the shade rows include a first set of shade rows, each of the first set of shade rows defining a first major edge portion and a first minor edge portion wherein the first set of shade rows narrow from the first major edge portion to the first minor edge portion in a first transverse direction, and a second set of shade rows, each of the second set of shade rows defining a second major edge portion and a second minor edge portion wherein the second set of shade rows narrow from the second major edge portion to the second minor edge portion in a second transverse direction.

17. The window shade of claim 16, wherein any of the first opening member and the securement members are cords.

18. The window shade of claim 16, wherein any of the first opening member and the securement members are strips of material.

19. The window shade of claim 16, wherein at least one of the plurality of rows includes a stiffened longitudinal portion.

20. The window shade of claim 19, wherein the stiffened longitudinal portion comprises a slat member.

21. The window shade of claim 16, wherein the shade rows define a first longitudinal margin which is secured to the first opening member and a second longitudinal margin which is secured to the securement members, a distance between the first longitudinal margin and the second longitudinal margin defining a row width, and wherein the first opening member and the securement members are adjustable to decrease the row width.

22. The window shade of claim 16, wherein the first set of shade rows is secured to the first opening member at the first major edge portion, and the second set of shade rows is secured to a second opening member at the second major edge portion.

23. The window shade of claim 16, wherein the first set of shade rows and the second set of shade rows alternate.

24. A window shade having a face and a rear, the window shade comprising:

a head rail;

a bottom rail;

a control mechanism positioned in the head rail;

a first suspension cord operatively connected to the control mechanism and extending from the head rail, the first suspension cord being detached from the bottom rail and comprising a plurality of spaced loops through which a first anchor member is guided;

a second suspension cord operatively connected to the control mechanism and extending from the head rail and comprising a plurality of spaced loops through which a second anchor member is guided;

a raising cord extending from the head rail and secured to the bottom rail such that the bottom rail hangs from the head rail;

a plurality of rows, each of the rows comprising a fabric panel;

at least one of the rows comprising an upper transverse edge portion, a lower transverse edge portion, and a central portion, the upper transverse edge portion being operatively connected to the first suspension cord, the lower transverse edge portion being operatively connected to the second suspension cord, and the central portion extending outward from the rear of the window shade; and the control mechanism adapted to raise the second suspension cord while also lowering the first suspension cord to narrow the at least one row.

25. A window shade having a face and a rear, the window shade comprising:

a head rail;

a bottom rail;

a control mechanism positioned in the head rail;

a first suspension cord operatively connected to the control mechanism and extending from the head rail, the first suspension cord being detached from the bottom rail and comprising a plurality of spaced loops through which a first anchor member is guided;

a second suspension cord connected to and hanging from the head rail, the second suspension cord comprising a plurality of spaced loops through which a second anchor member is guided;

the first suspension cord and the second suspension cord being spaced from one another;

a raising cord extending from the head rail and secured to the bottom rail such that the bottom rail hangs freely from the head rail;

a plurality of rows, each of the rows comprising a fabric panel;

at least one of the rows comprising an upper transverse edge portion, a lower transverse edge portion, and a central portion, the upper transverse edge portion being operatively connected to the first suspension cord, the lower transverse edge portion being operatively connected to the second suspension cord, and the central portion extending outward from the rear of the window shade;

the control mechanism adapted to lower the first suspension cord to narrow the row; and the second suspension cord remaining stationary relative to the head rail as the row is narrowed.

* * * * *

UNITED STATES PATENT AND TRADEMARK OFFICE

CERTIFICATE OF CORRECTION

PATENT NO. : 7,275,580 B2
APPLICATION NO. : 10/914579
DATED : October 2, 2007
INVENTOR(S) : Yu et al.

It is certified that error appears in the above-identified patent and that said Letters Patent is hereby corrected as shown below:

Column 9, line 6, delete “Set” and insert --set--

Col. 12, Claim 10, line 48, delete “shows” and insert --rows--

Signed and Sealed this

Third Day of June, 2008

JON W. DUDAS
*Director of the United States Patent and Trademark Office*